US006464949B1

(12) United States Patent
Lenglet et al.

(10) Patent No.: US 6,464,949 B1
(45) **Date of Patent: *Oct. 15, 2002**

(54) STEAM CRACKING INSTALLATION WITH MEANS FOR PROTECTION AGAINST EROSION

(75) Inventors: Eric Lenglet, La Celle Saint Cloud; Jean-Pierre Burzynski, Sainte-Foy-les Lyon; Gérard Courteheuse, Rueil-Malmaison; Roland Huin, Montesson la Borde; Yves Gougne, Givors, all of (FR)

(73) Assignee: Institut Francais du Petrole, Rueil Malmaison (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/202,786

(22) PCT Filed: Jun. 24, 1997

(86) PCT No.: PCT/FR97/01119

§ 371 (c)(1),
(2), (4) Date: Mar. 8, 1999

(87) PCT Pub. No.: WO97/49782

PCT Pub. Date: Dec. 31, 1997

(30) Foreign Application Priority Data

Jun. 25, 1996 (FR) ..... 96 07872

(51) Int. Cl.[7] ..... C10G 9/18

(52) U.S. Cl. ..... 422/198; 422/200; 422/201; 422/202; 422/205; 422/207; 422/213; 422/217

(58) Field of Search ..... 208/130, 126, 208/48 R; 422/194, 198, 200, 201, 202, 205, 207, 213, 217, 220; 196/126, 125, 127; 585/648, 652, 950

(56) References Cited

U.S. PATENT DOCUMENTS

| | | | | | |
|---|---|---|---|---|---|
| 2,289,350 | A | * | 7/1942 | Dixon et al. | 134/20 |
| 4,002,433 | A | * | 1/1977 | Oser | 422/176 |
| 4,420,343 | A | * | 12/1983 | Sliwka | 134/22.15 |
| 4,680,908 | A | * | 7/1987 | Crowley | 52/378 |
| 5,177,292 | A | * | 1/1993 | Lenglet | 585/648 |
| 5,183,642 | A | * | 2/1993 | Lenglet | 422/213 |
| 5,186,815 | A | * | 2/1993 | Lenglet | 208/48 R |
| 5,321,191 | A | * | 6/1994 | Alagy et al. | 585/648 |
| 5,965,013 | A | * | 10/1999 | Lenglet et al. | 208/130 |

FOREIGN PATENT DOCUMENTS

| | | | |
|---|---|---|---|
| EP | 036151 | | 9/1981 |
| FR | 2728582 | * | 6/1996 |
| WO | 9012851 | | 11/1990 |
| WO | 9620259 | | 7/1996 |

* cited by examiner

*Primary Examiner*—Marian C. Knode
*Assistant Examiner*—Basia Ridley
(74) *Attorney, Agent, or Firm*—Millen, White, Zelano & Branigan, P.C.

(57) ABSTRACT

A steam-cracking unit comprises at least one multitube quenching exchanger, equipped with a non-obstructive impact separator for preventing the erosion of the tubular input plate. The impact separator is at least 50% opaque when viewed from transfer pipe. It is arranged inside of an input cone in such a way that there is free passage of at least 40 mm between the periphery of the impact separator and the cone.

8 Claims, 1 Drawing Sheet

STEAM CRACKING INSTALLATION WITH MEANS FOR PROTECTION AGAINST EROSION

FIELD OF THE INVENTION

The invention relates to a conventional steam-cracking unit that comprises at least one furnace with pyrolysis pipes that are connected downstream to at least one multitube-type quenching exchanger for cracked gases with a tubular input plate. Such conventional units use means for introducing decoking agents that consist of lines for introducing decoking fluids from the group of air, vapor, and air/vapor mixtures.

BACKGROUND OF THE INVENTION

It is known to one skilled in the art that these conventional steam-cracking furnaces are subject to erosion phenomena due to the circulation of deslagged coke fragments from the pyrolysis pipes during decoking periods (with air, with vapor, or with air/vapor mixtures). Said coke fragments are endogenous coke fragments (inside the unit) and give rise to serious erosion phenomena, whereas within the framework of this invention only erosive (external) solid particles are introduced into the unit.

The prior art is illustrated by Patent Applications WO 90 12851 and EP-A-036151. In addition, Application WO 96 20259 describes a decoking process for steam-cracking furnace pipes by erosive particles that are introduced upstream from a distributor impact separator at the input of an indirect quenching exchanger.

It is also known to one skilled in the art that the most serious erosion problems are observed at the tubular plate of the quenching exchanger, which is very generally thin (about 10 mm) and therefore fragile.

SUMMARY OF THE INVENTION

The object of the invention is to propose a unit that uses means of protection against erosion, in particular at the tubular input plate of the exchanger.

Another object of the invention is to propose means of protection that do not pose obstruction risks during times when there is circulation of considerable amounts of deslagged coke fragments from the upstream walls (pyrolysis pipes).

Finally, another object of the invention is to propose holding means that are strong and reliable for the protection means inside a cone with a small internal volume.

For this purpose, a hydrocarbon steam-cracking unit in pyrolysis pipes that comprises at least one furnace that comprises at least one multitube quenching exchanger with a tubular input plate is proposed, wherein this unit uses means for introducing decoking agents and wherein said means consist of a number of lines for introducing decoking fluids from the group of air, water vapor, and air/vapor mixtures, wherein said quenching exchanger comprises an input cone that is connected upstream by a transfer pipe, wherein this unit is characterized in that it comprises an impact separator that comprises solid surfaces that are placed opposite the transfer pipe, wherein said impact separator is at least 50% opaque when viewed from said transfer pipe that is located upstream, and wherein the impact separator is placed inside the cone in such a way that there is free passage of at least 40 mm and preferably at least 80 mm between the periphery of the impact separator and the cone over the bulk of the periphery of the impact separator.

The free passage can be equal to at most half the diameter of the tubular plate.

Input cone is defined as a transition zone with a section that expands significantly and with a shape that is generally at least partially tapered, wherein said zone is connected upstream to the pipe for transfer of cracked gases that come from the pyrolysis pipes and downstream to the tubular plate of the quenching exchanger. Said cone can also be flared "trumpetlike" or be open-ended in shape.

Preferably, the impact separator will be at least 70% or even 100% opaque, viewed from the upstream transfer pipe.

An impact separator that is at least 70% opaque is defined as an impact separator for which at least 70% of the stream lines of the transfer pipe when said lines are extended parallel to the axis of the cone meet the impact separator.

In other words, the projected surface area of the various elements of the impact separator, over the end section of the transfer pipe, represents at least 70% of this section. (The section of the pipe is the surface area that is delimited by the circle that corresponds to the inside diameter of the pipe, just. upstream from the cone, wherein the surface area is projected parallel to the axis of the cone.)

The gas passages can be non-communicating or communicating, for example at ends of solid surfaces that constitute the impact separator, as it will be described below.

According to a characteristic variant, the unit is characterized in that the impact separator comprises at least one row of approximately parallel bars. These parallel bars can have, in particular, a circular section, a circular section with cut sides, a square section, or a rectangular section.

The bars can be approximately perpendicular to the axis of the exchanger according to another embodiment.

According to another embodiment, the axis of the bars can have an angle that differs by 90 degrees from that of the axis of the exchanger. These bars can have, for example, a V-shape.

According to another characteristic variant, the impact separator comprises at least two rows of parallel bars that are arranged according to at least two levels, wherein the bars are separated by empty spaces and are offset such that the empty spaces at one of the levels are opposite the bars that are arranged at the other level.

According to a preferred embodiment, the bars are attached to a bracket that is perpendicular to these bars and is arranged approximately in their center.

Finally, according to a characteristic design variant, the input cone comprises a metal outside wall and a metal inside wall that is preferably welded to the outside wall, wherein the space between these two walls is filled by a refractory packing that is a relatively poor heat conductor and is made of, for example, refractory concrete, wherein said impact separator is attached to the inside wall by at least two attachment lugs.

Reference is now made to the figures, which will more clearly illustrate the invention:

DETAILED DESCRIPTION

Figure 1:
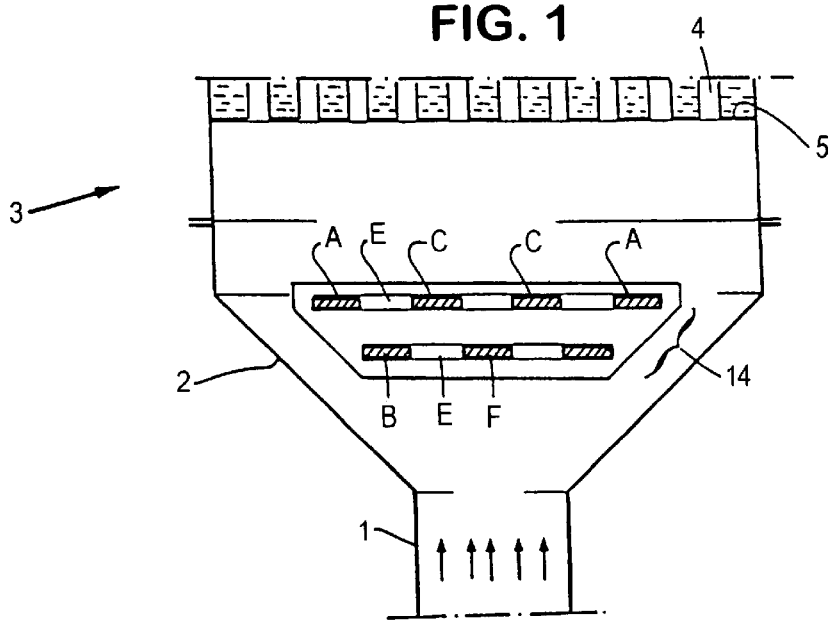
FIG. 1 is a side view of a portion of a hydrocarbon steam cracking unit used in pyrolysis pipes showing a first embodiment of an impact separator.

FIG. 1 shows the characteristic portion of a hydrocarbon steam-cracking in pyrolysis pipes that have at least one furnace unit according to the invention: it shows a quenching exchanger (3), with a number input lines in the form of pipes(4), an input tube plate (5), and a transfer pipe (1) toward input cone (2) of the quenching exchanger. Impact separator (6) comprises a number of surfaces (A, B, C, F), as well as empty spaces (E) that form several gas passages. Said impact separator is located opposite transfer pipe (1), downstream lines of this transfer pipe, which are symbolized by arrows.

In examining FIG. 1, it is seen that if the arrows that are located in transfer pipe (1) are extended, said arrows meet at least one of solid surfaces A, B, C, F. Said impact separator (6) is therefore 100% opaque when viewed from transfer pipe (1) toward input cone (2) of the quenching exchanger (3). It is still gas-permeable thanks to empty spaces (E), which form a number of gas passages. Advantageously, an impact separator that comprises a larger number of solid surfaces (for example, between 8 and 20), and gas passages, not shown in FIG. 1, will be used.

As is also seen, said impact separator comprises two solid surface levels: A and C, on the one hand, and B and F, on the other, wherein empty spaces (E) at one of the levels are approximately opposite the solid surfaces of the other level.

A, B, C and F are rectilinear bars with a rectangular section that are made of a refractory alloy, and they can be made integral and attached to cone (2) or to tubular plate (5) by attaching lugs, not shown.

Figure 2:
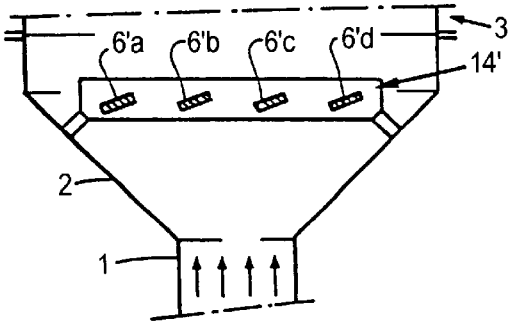
FIG. 2 is a side view of a second embodiment of an impact separator configured in accordance with the present invention and disposed in a portion of a hydrocarbon steam cracking unit.

FIG. 2 shows in particular another type of impact separator 14' that comprises a row of impact separator bars 6' that are inclined crosswise (6'*a*, 6'*b*, 6'*c*, 6'*d*), arranged at a single level.

Figure 3A:
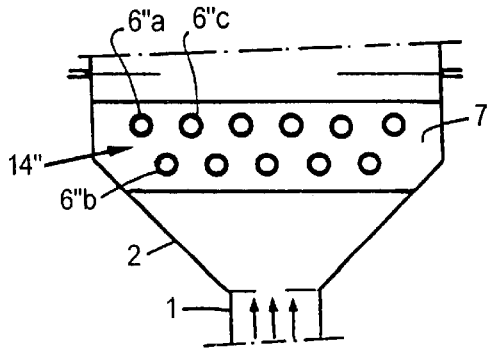
FIG. 3A is a side view of a third embodiment of an impact separator configured in accordance with the present invention and disposed in a portion of a hydrocarbon steam cracking unit.
Figure 3B:
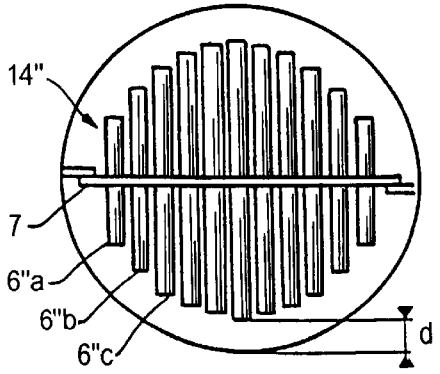
FIG. 3B is a top view of the impact separator of FIG. 3A.

FIGS. 3A, 3B illustrate another variant of impact separator separator $\mathbf{14}^{11}$ with $\text{bars}_{11}$, (6) that comprises a number of bars ($\mathbf{6}a^{11}$, $\mathbf{6}b^{11}$, $\mathbf{6}c^{11}$ ) that are rectilinear, that have a circular section, that are approximately parallel and are arranged according two levels. Said bars are supported by a single central bracket (7) that is approximately perpendicular to the axis of the bars. The end of the bars is located at a distance d from the cone of at least 80 mm.

According to FIG. 3B, the projections of the bars 6" are not contiguous, whereby the free projected space is at most 30% of the total space, viewed from the pipe.

Figure 4:
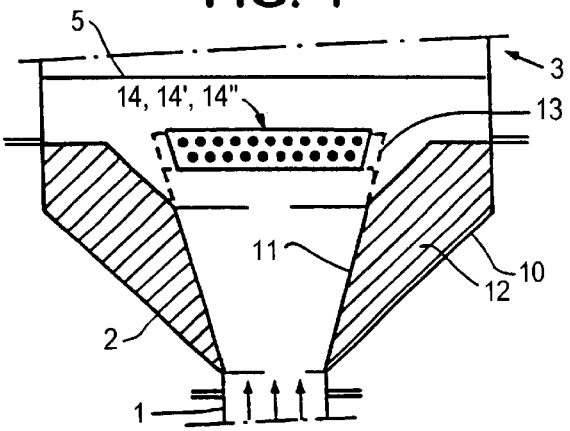
FIG. 4 is a side view of an embodiment of the invention showing an impact separator in a portion of a hydrocarbon steam cracking unit wherein the refractory packing is used adjacent to the impact separator.

FIG. 4 shows a characteristic design variant of a particular cone, according to the invention, with a very reliable attachment system for an internal impact separator.

Input cone (2) comprises an outside, pressure-resistant metal wall (10) and an inside metal wall (11), such as a cone for slowing down the cracked gases. The space between two metal walls (10) and (11) is filled by a refractory packing (12) such as refractory concrete. An impact separator with bars 6, $\mathbf{6}^1$ or $\mathbf{6}^{11}$ is attached to inside metal wall (11) by attachment lugs (13), of which there are at least two and preferably three or four.

This cone and this attachment method are particularly advantageous according to the invention: Actually, outside large-dimension metal wall (10) is relatively cold because of the relatively insulating refractory concrete. Its cost is therefore modest. In contrast, it becomes very difficult to hook the impact separators 14, $\mathbf{14}^1$ or $\mathbf{14}^{11}$ to this wall, the impact separators actually having a very high temperature, close to that of cracked gases. The integral attachment of the impact separator to outside jacket (10) therefore comes up against differential expansion problems.

Attaching the impact separators (14, $\mathbf{14}^1$ and $\mathbf{14}^{11}$) to relatively cold tubular plate (5) is difficult for the same reasons. Attachment to the refractory concrete by anchoring points is also difficult due to the differences in the coefficients of thermal expansion between the concrete and the metal impact separator.

In contrast, attaching the impact separators (14, $\mathbf{14}^1$ to and $\mathbf{14}^{11}$) to inside wall (11) is very simple and reliable because these two elements are metal and have very similar temperatures.

The steam-cracking unit operates in a conventional manner, with alternating cracking phases and decoking phases with typical circulation of an air/vapor mixture. It is also possible to inject non-erosive chemical additives to reduce coking.

During the decoking phases, a considerable amount of coke fragments are deslagged from the pyrolysis pipes and are conveyed at great speed (for example 170 m/s) to the input of the quenching exchanger.

According to the invention, the impact separator keeps the bulk of these fragments from impacting directly on the tubular plate and significantly extends the service life of the quenching exchanger, for example, doubling it.

Compared to toric bars, the parallel bars represent a very significant advantage according to a characteristic variant of the invention because there is no possibility of accumulation or blocking by coke pieces between two adjacent bars: unlike toric bars or fragments, they cannot slide radially; the coke fragments can easily slide toward the outside, parallel to the bars, and can be evacuated into the outside annular space, which is open except right at the attachment lugs.

The invention therefore proposes a relatively simple and effective technical solution without risks of obstruction by coke accumulations.

What is claimed is:

1. A hydrocarbon steam-cracking unit that contains pyrolysis pipes, the unit having at least one furnace with at least one multitube quenching exchanger (3) having an input tube plate (5), and having a number of lines (4) extending through the tube plate (5) for introducing decoking fluids selected from the group consisting of air, water vapor, and air/vapor mixtures, said quenching exchanger comprising an input cone (2) connected downstream of a transfer pipe (1), said pipe being connected to the input cone, the steam-cracking unit comprising an impact separator (14) that includes solid surfaces that are placed opposite the transfer pipe (1), said impact separator having a periphery and being at least 50% opaque when viewed from said transfer-pipe (1) located upstream of the impact separator, wherein the impact separator (14) is placed inside the input cone in such a way that there is free passage between the periphery of the impact separator (14) and the cone of at least 40 mm around the periphery of the impact separator.

2. A unit according to claim 1, wherein the impact separator comprises at least one row of parallel bars (6'*a*–6'*d* or 6"*a*–6"*c*).

3. A unit according to claim 2, wherein the impact separator comprises at least two rows of parallel bars that are placed according to two levels, and wherein the bars are separated by empty spaces and are offset in such a way that the empty spaces at one of the levels are opposite the bars that are arranged at the other level.

4. A unit according to claim 2, wherein the bars (6) are attached to a bracket (7) that is perpendicular to the bars and is arranged approximately in their center.

5. A unit according to claim 1, wherein said free passage between the periphery of the impact separator and the cone is at most equal to half of the diameter of the tubular input plate (5).

6. A unit according to claim 1 wherein the free passage between the periphery of the impact separator is at least 80 mm.

7. A hydrocarbon steam-cracking unit that contains pyrolysis pipes, the unit having at least one furnace with at least one multitube quenching exchanger (3) having an input tube plate (5), and using a number of lines (4) extending through the tube plate (5) for introducing decoking fluids selected from the group consisting of air, water vapor, and air/vapor mixtures, said quenching exchanger comprising an input cone (2) connected downstream of a transfer pipe (1), said pipe being connected to the input cone, steam-cracking unit comprising an impact separator (14) that includes solid surfaces that are placed opposite the transfer pipe (1), said impact separator having a periphery and being at least 50% opaque when viewed from said transfer pipe (1) located upstream of the impact separator, wherein the impact separator (14) is placed inside the input cone in such a way that there is free passage between the periphery of the impact separator (14) and the cone of at least 40 mm around the periphery of the impact separator, the input cone (2) comprising an outside metal wall (10) and an inside metal wall (11) that is welded to the outside wall, there being a space between these two walls which is filled with a refractory packing (12) that is a poor heat conductor.

8. A unit according to claim 7 wherein the refractory packing is a refractory concrete.

* * * * *